US009466244B2

(12) United States Patent
Takahara

(10) Patent No.: US 9,466,244 B2
(45) Date of Patent: Oct. 11, 2016

(54) EL DISPLAY DEVICE AND PRODUCTION METHOD THEREFOR

(71) Applicant: JOLED INC., Tokyo (JP)

(72) Inventor: Hiroshi Takahara, Osaka (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 14/376,733

(22) PCT Filed: Dec. 3, 2012

(86) PCT No.: PCT/JP2012/007728

§ 371 (c)(1),
(2) Date: Aug. 5, 2014

(87) PCT Pub. No.: WO2013/118219

PCT Pub. Date: Aug. 15, 2013

(65) Prior Publication Data

US 2014/0361961 A1 Dec. 11, 2014

(30) Foreign Application Priority Data

Feb. 8, 2012 (JP) ..... 2012-024699

(51) Int. Cl.
*G09G 3/3233* (2016.01)
*G09G 3/32* (2016.01)
*G09G 3/00* (2006.01)

(52) U.S. Cl.
CPC ..... *G09G 3/3291* (2013.01); *G09G 3/006* (2013.01); *G09G 3/325* (2013.01); *G09G 3/3233* (2013.01); *G09G 2300/0408* (2013.01); *G09G 2310/0262* (2013.01); *G09G 2310/0286* (2013.01); *G09G 2330/12* (2013.01); *G09G 2380/02* (2013.01)

(58) Field of Classification Search
CPC ..... G09G 3/3291; G09G 3/3233; G09G 2310/0262; G09G 2380/02; G09G 2330/12; G09G 2300/0408
See application file for complete search history.

(56) References Cited

U.S. PATENT DOCUMENTS 6,104,449 A 8/2000 Takahashi et al.
6,583,775 B1 6/2003 Sekiya et al.

(Continued)

FOREIGN PATENT DOCUMENTS

CN 1581246 2/2005
CN 101409040 4/2009

(Continued)

OTHER PUBLICATIONS

International Search Report (ISR) in International Patent Application No. PCT/JP2012/007728, dated Mar. 5, 2013.

(Continued)

*Primary Examiner* — Shaheda Abdin
(74) *Attorney, Agent, or Firm* — Greenblum & Bernstein, P.L.C.

(57) ABSTRACT

An EL display device includes an EL display panel including a plurality of pixels each having an EL element. Each of the pixels has: driving transistor that supplies a current to EL element; first switching transistor; and second switching transistors that supply video signals to the pixel. The EL display device also includes: gate driver circuit that is formed and disposed along with pixels on the EL display panel; and gate driver IC that is externally connected to gate signal lines. Gate driver circuit is connected to a gate terminal of first switching transistor, and gate driver IC is connected to gate terminals of second switching transistors.

10 Claims, 12 Drawing Sheets

(56) References Cited

U.S. PATENT DOCUMENTS

| | | | | |
|---|---|---|---|---|
| 7,852,301 | B2 | 12/2010 | Chiou et al. | |
| 8,018,404 | B2 | 9/2011 | Ono | |
| 8,248,331 | B2 | 8/2012 | Ono | |
| 8,289,350 | B2 | 10/2012 | Matsui et al. | |
| 8,294,701 | B2 | 10/2012 | Matsui et al. | |
| 8,749,454 | B2 | 6/2014 | Ono | |
| 2006/0017665 | A1 | 1/2006 | Ko et al. | |
| 2006/0022305 | A1 | 2/2006 | Yamashita | |
| 2006/0267889 | A1 | 11/2006 | Kimura | |
| 2007/0080905 | A1* | 4/2007 | Takahara | G09G 3/3233 345/76 |
| 2008/0165483 | A1* | 7/2008 | Tanaka | H05K 7/205 361/679.01 |
| 2009/0096721 | A1 | 4/2009 | Chiou et al. | |

FOREIGN PATENT DOCUMENTS

| | | |
|---|---|---|
| CN | 101673511 | 3/2010 |
| JP | 11-142888 | 5/1999 |
| JP | 2001-060076 | 3/2001 |
| JP | 2005-164892 | 6/2005 |
| JP | 2006-039541 | 2/2006 |
| JP | 2006-309104 | 11/2006 |
| JP | 2006-350304 | 12/2006 |
| JP | 2007-025317 | 2/2007 |
| JP | 2007-225928 | 9/2007 |
| JP | 2010-282060 | 12/2010 |
| WO | 2004/100118 | 11/2004 |

OTHER PUBLICATIONS

Office Action from the Patent Office of the People's Republic of China (SIPO) in Chinese Patent Application No. 201280069316.5, dated Nov. 3, 2015, together with a partial English language translation.

* cited by examiner

EL DISPLAY DEVICE AND PRODUCTION METHOD THEREFOR

TECHNICAL FIELD

The present disclosure relates to an EL display device having electroluminescence (hereinafter referred to as EL) elements using organic materials as luminescent materials, which are arranged in a matrix, and a production method therefor.

BACKGROUND ART

Active matrix EL display devices that each include organic EL elements in a matrix are used as display devices such as smart phones, and commercialized. Recently, EL display panels are being developed for enlargement.

This EL display device requires a plurality of transistors to configure pixels, and also requires gate signal lines that control the transistors, as shown in PTLs 1, 2 and 3. Therefore, compared to a liquid crystal panel, a pixel configuration is complicated, and a driving method is also complicated.

CITATION LIST

Patent Literature

PTL 1: Unexamined Japanese Patent Publication No. 2005-164892

PTL 2: Unexamined Japanese Patent Publication No. 2001-60076

PTL 3: Unexamined Japanese Patent Publication No. 2007-225928

SUMMARY DISCLOSURE

An EL display device of the present disclosure includes: an EL display panel that has a display area provided with a plurality of pixels arranged in a matrix, each of the pixels having an EL element; a source driver circuit that supplies a video signal through a source signal line connected to each of the pixels; and a gate driver circuit that supplies a selection voltage or a non-selection voltage through a gate signal line connected to each of the pixels. Each of the pixels has: a driving transistor that supplies a current to the EL element; a first switching transistor that is connected to the driving transistor and controls the current supplied to the EL element; and a second switching transistor that is connected to the source signal line and supplies the video signal to each of the pixels. Furthermore, the gate driver circuit includes: a first gate driver circuit that is formed and disposed along with each of the pixels on the EL display panel; and a second gate driver circuit that is externally connected to the gate signal lines of the EL display panel. The first gate driver circuit is connected to a gate terminal of the first switching transistor of each of the pixels via the gate signal line, and the second gate driver circuit is connected to the gate terminal of the second switching transistor of each of the pixels via the gate signal line.

A production method for an EL display device of the present disclosure is a production method for an EL display device including: an EL display panel that has a display area provided with a plurality of pixels arranged in a matrix, each of the pixels having an EL element; a source driver circuit that supplies a video signal through a source signal line connected to each of the pixels; and a gate driver circuit that supplies a selection voltage or a non-selection voltage through a gate signal line that is connected to each of the pixels. Each of the pixels has; a driving transistor that supplies a current to the EL element; a first switching transistor that is connected to the driving transistor and controls the current supplied to the EL element; and a second switching transistor that is connected to the source signal line and supplies the video signal to each of the pixels. Furthermore, the gate driver circuit has: a first gate driver circuit that is formed and disposed along with each of the pixels on the EL display panel; and a second gate driver circuit that is externally connected to the gate signal lines of the EL display panel. The first gate driver circuit is connected to a gate terminal of a first switching transistor of each of the pixels via the gate signal line, and second gate driver circuit is connected to a gate terminal of the second switching transistor of each of the pixels via the gate signal line. Furthermore, the EL display panel is formed with a test circuit that supplies a test signal to each of the pixels through the source signal line. After performing inspection for supplying the test signal to each of the pixels of the EL display panel, the test circuit is separated from the EL display panel.

With this configuration, it is possible to implement optimum on/off control for each of a plurality of transistors that configure pixels, and therefore it is possible to implement an EL display device that facilitates inspection with a simple configuration. Additionally, it is possible to rapidly perform inspection at the time of panel inspection.

DESCRIPTION OF EMBODIMENT

Hereinafter, an EL display device according to an exemplary embodiment is described with reference to the drawings.

Figure 1:
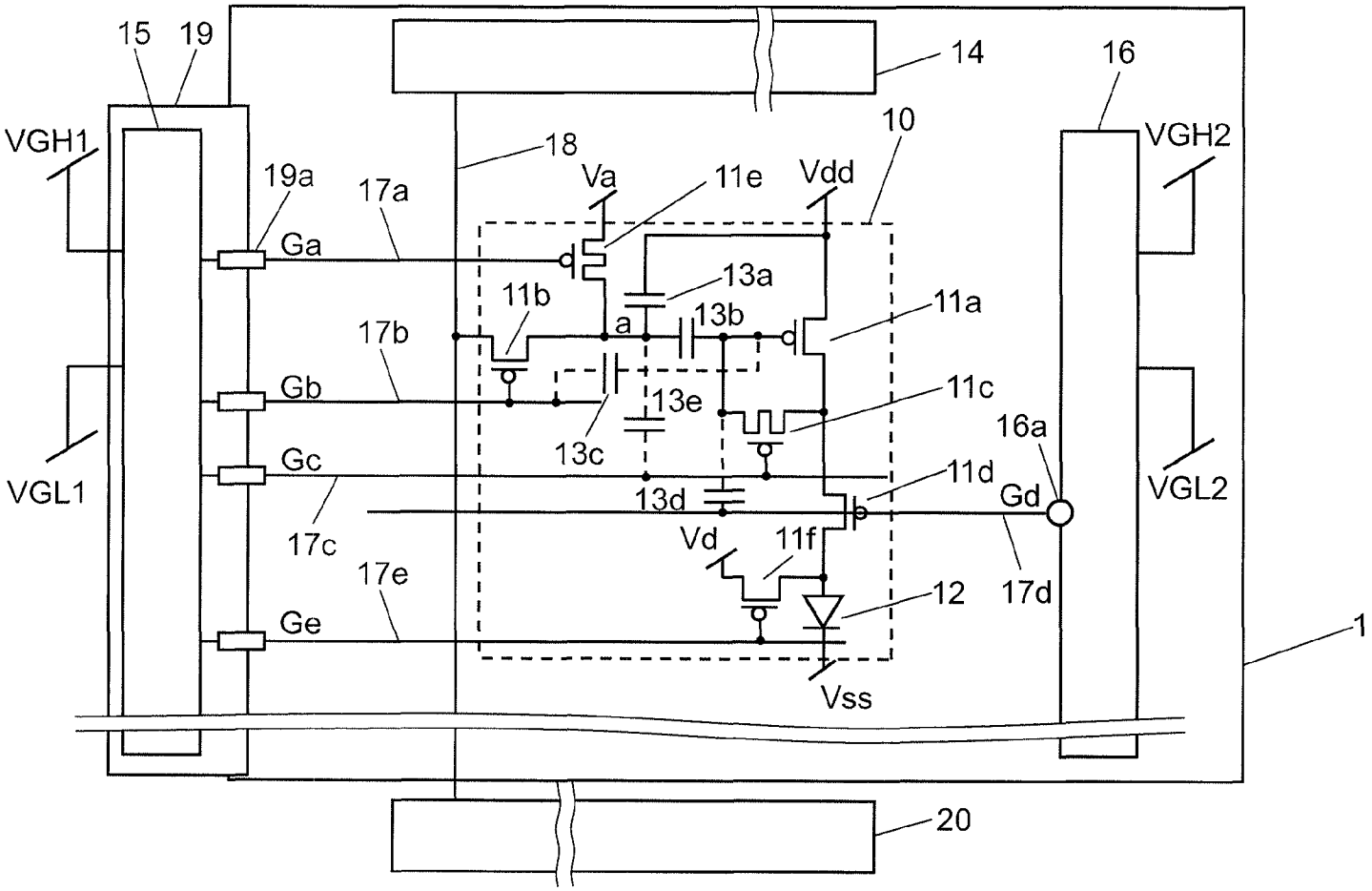
FIG. 1 is a schematic configuration diagram of a pixel of an EL display device according to an exemplary embodiment.

FIG. 1 is a schematic configuration diagram of a pixel of the EL display device according to the exemplary embodiment. Note that FIG. 1 shows only a main part of the EL display device.

As shown in FIG. 1, the EL display device is configured from EL display panel 1, and a circuit board mounted with a drive circuit thereon. EL display panel 1 has a configuration in which a plurality of pixels each having an EL element are arranged in a matrix in a display area.

A configuration of the pixel is now described. Single pixel 10 has a configuration in which a source terminal of switching transistor 11*d* is connected to a drain terminal of P-channel driving transistor 11*a*, and an anode terminal of EL element 12 is connected to a drain terminal of transistor 11*d*. Transistors 11*b*, 11*c*, 11*e* and 11*f* are other switching transistors provided in pixel 10, and capacitors 13*a*, 13*b*, 13*c*, 13*d* and 13*e* are capacitors for controlling ON/OFF of transistors 11*a* to 11*f*.

Cathode voltgage Vss is applied to a cathode terminal of EL element 12, anode voltage Vdd is applied to a source terminal of transistor 11*a* from an anode electrode of the EL display device, and anode voltage Vdd and cathode voltgage Vss are set to have a relation of anode voltage Vdd>cathode voltgage Vss.

The drive circuit has source driver IC 14 that serves as a source driver circuit, gate driver IC 15 that serves as a gate driver circuit, and gate driver circuit 16 that is incorporated in EL display panel 1. Source driver IC 14, gate driver IC 15 and gate driver circuit 16, and pixel 10 are electrically connected to each other via gate signal lines 17 (17*a*, 17*b*, 17*c*, 17*d*, 17*e*) and source signal line 18. Additionally, gate driver circuit 16 that has terminal electrode 16*a*, to which gate signal line 17*d* is connected, is formed and disposed along with pixel 10 on EL display panel 1, so that gate driver circuit 16 is incorporated in EL display panel 1. That is, gate driver circuit 16 is simultaneously formed by use of a manufacturing process of the transistor of pixel 10 of EL display panel 1. On the other hand, gate driver IC 15 is mounted on flexible board (hereinafter referred to as a COF) 19 that serves as a circuit board having terminal electrodes 19*a*, to which gate signal lines 17*a*, 17*b* and 17*c* and 17*e* are connected. Gate driver IC 15 is externally connected to gate signal lines 17*a*, 17*b* and 17*c* and 17*e* of EL display panel 1 via this COF 19. Gate driver IC 15 may be externally directly connected to a connection terminal of EL display panel 1 without COF 19 to be mounted.

Gate driver IC 15 and gate driver circuit 16 may be formed by any method of high temperature polysilicon, low temperature polysilicon, continuous grain boundary silicon, transparent amorphous oxide semiconductor, amorphous silicon, and the like. Additionally, gate driver IC 15 and gate driver circuit 16 have shift register circuits and buffer circuits for sequentially supply signals to gate signal lines 17, as described later. A scanning direction of the shift register circuit is inverted, so that a display screen of EL display panel 1 is vertically inverted to be displayed.

In FIG. 1, reference numeral 20 denotes a test circuit, which is disposed outside EL display panel 1, and electrically connected to source signal line 18. Additionally, test circuit 20 is separated after panel inspection in a production process of EL display panel 1.

As shown in FIG. 1, in the gate signal line, to which a signal for controlling selection/non-selection of light emission of pixel 10 is supplied, when an ON-state voltage is applied to gate signal lines 17*d* (Gd), transistor 11*d* is turned on, a light emitting current from transistor 11*a* is supplied to EL element 12, and EL element 12 emits light on the basis of magnitude of the light emitting current. A video signal applied to source signal line 18 is applied to pixel 10 through switching transistor 11*b*, thereby determining the magnitude of the light emitting current.

That is, a source terminal and a drain terminal of transistor 11*b* are connected between a gate terminal and the drain terminal of transistor 11*a*, and an ON-state voltage is applied to gate signal line 17*b* (Gb), resulting in a short circuit (connection) between the gate terminal and the drain terminal of transistor 11*a*. One of terminals of capacitor 13*b* is connected to the gate terminal of transistor 11*a*, and the other terminal of capacitor 13*b* is connected to the drain terminal of transistor 11*b*. A source terminal of transistor 11*c* is connected to source signal line 18 through transistor 11*b*. When an ON-state voltage of gate signal line 17*c* (Gc) is applied to a gate terminal of transistor 11*c*, transistor 11*c* is turned on, and voltage Vss is applied to pixel 10 in accordance with the video signal supplied to source signal line 18.

One of terminals of capacitor 13*a* of pixel 10 is connected to the drain terminal of transistor 11*b*, and the other terminal is connected to the anode electrode of the EL display device, so that anode voltage Vdd is applied.

Drain terminal of transistor 11*e* is connected to the drain terminal of transistor 11*b*, and source terminal of transistor 11*e* is connected to a signal line, to which a reset voltage Va is applied. An ON-state voltage is applied to gate signal line 17*a* (Ga), so that transistor 11*e* is turned on, and reset voltage Va is applied to capacitor 13*a*.

Herein, for transistors 11*c* and 11*e*, P-channel transistors are employed, and an LDD structure is employed. That is, a structure in which gates of a plurality of transistors are connected in series is employed, thereby enabling favorable off-characteristics of transistors 11*c* and 11*e*. Similarly, for the transistors other than transistors 11*c* and 11*e*, P-channel transistors are preferably employed, and an LDD structure is preferably employed. A multi-gate structure is employed as necessary, so that off-leakage can be suppressed, and favorable contrast and offset cancellation operation can be implemented.

Although capacitor 13*a* has a configuration in which anode voltage Vdd is applied, the present disclosure is not limited to this, and other arbitrary DC voltage may be connected. Similarly, transistor 11*a* may have a configuration in which an arbitrary DC voltage other than anode voltage Vdd is applied. That is, the same voltage is not applied to capacitor 13*a* and the source terminal of transistor 11*a*, and different voltages are applied to capacitor 13*a* and the source terminal of transistor 11*a*. For example, such a connection configuration in which anode voltage Vdd is applied to the source terminal of transistor 11*a*, and DC voltage Vb (5 (V)) is applied to capacitor 13*a* may be applied.

In a case of a digital driving system in which pixel 10 is turned on and off, or is digitally lit, like a PWM driving system, a predetermined voltage value is applied to pixel 10 through transistor 11*b*, transistor 11*d* is turned on/off in accordance with the number of bits corresponding to gradation of a video signal, and light emitting driving control is performed by gradation display. Additionally, on/off control of transistor 11*d* is performed, so that zonal black display (non-display) is caused in the display area, thereby controlling an amount of a current that flows in the display area.

Actions of capacitors 13*c* and 13*d*, shown by dotted lines in FIG. 1 are described below. Capacitor 13*c* is formed between gate signal line 17*b* and transistor 11*a*, and capacitor 13*d* is formed between gate signal line 17*d* and the gate terminal of transistor 11*a*. Capacitors 13*c* and 13*d*, and the like each are referred to as a through capacitor, and a voltage for changing, or a changed voltage is referred to as a through voltage.

In FIG. 1, when an ON-state voltage (VGL1) is applied to gate signal line 17*b*, transistor 11*b* is in an ON-state, and a video signal applied to source signal line 18 is applied to pixel 10. Then, when the voltage applied to gate signal line 17*b* is changed from ON-state voltage VGL1 to OFF-state voltage VGH1, transistor 11*b* is turned off. At this time, a voltage of an end of capacitor 13*c* is also changed from VGL1 to VGH1, and the voltage based on the change is transmitted to the gate terminal of transistor 11*a*. A direction of the transmitted voltage is a direction in which a gate terminal voltage of transistor 11*a* rises, and transistor 11*a* is a P-channel transistor, and therefore change of the voltage causes a direction in which a current that flows through EL element 12 by transistor 11*a* is reduced, so that it is possible to implement favorable black display.

Thus, a gate terminal voltage of driving transistor 11*a* (potential of capacitor 13*e*) is changed via a capacity of capacitor 13*c*, thereby enabling favorable black display.

When transistor 11*d* is in an ON-state, VGL2 voltage is applied to gate signal line 17*d*. When transistor 11*d* is in an OFF-state, VGH2 voltage is applied to gate signal line 17*d*. Transistor 11*d* is in an OFF-stage during offset cancellation operation. When EL element 12 is caused to emit light, transistor 11*d* is in an ON-state. Therefore, at the time of display start, gate signal line 17*d* is changed from VGH2 voltage to VGL2 voltage. Accordingly, the gate terminal voltage of transistor 11*a* is reduced by the action of through capacitor 13*d*. When the gate terminal voltage of transistor 11*a* is reduced, transistor 11*a* can causes a large current to flow through EL element 12, thereby enabling high luminance display.

Thus, the gate terminal voltage of driving transistor 11*a* is changed via a capacity of capacitor 13*d*, so that amplitude of the current that flows through EL element 12 is increased, thereby enabling high luminance display.

The capacity of capacitor 13*c* is preferably between 1/12 and 1/3 (inclusive) of a capacity of capacitor 13*a* or capacitor 13*b*. When a capacity ratio of capacitor 13*c* is too small, a change rate of the gate terminal voltage of transistor 11*a* becomes too large, and a difference from an ideal value of an offset cancellation state becomes too large. Additionally, when the capacity ratio is too large, the change of gate terminal voltage of transistor 11*a* becomes small, thereby making it difficult to obtain an effect.

Capacitor 13*c* that causes a through voltage is preferably changed on the basis of R, G and B pixel sizes modulated by pixels, magnitude of a current to be supplied, or a WL ratio of a driving transistor. This is because driving currents of respective EL elements 12 of R, G and B pixels are different, and current values or voltage values of a black level are different. For example, in a case where capacitor 13*c* of the R pixel is set to 0.02 pF, capacitors 13*c* of other colors (G and B pixels) are set to 0.025 pF. In a case where capacitor 13*c* of the R pixel is set to 0.02 pF, capacitor 13*c* of the G pixel is set to 0.03 pF, and capacitor 13*c* of the B pixel is set to 0.025 pF.

Thus, the capacity of capacitor 13*c* is changed for each of the R, G and B pixels, so that an offset cancellation voltage, a driving current of the black level, or a voltage of the black display can be adjusted for each of the R, G and B pixels.

Furthermore, the through voltage is determined by a difference of a relative capacity between holding capacitors 13*a* and 13*b* and through voltage generating capacitor 13*c*, and therefore the present disclosure is not limited to change of the capacities of capacitors 13*c* for the R, G and B pixels, and the capacity of holding capacitor 13*a* may be made variable. For example, in a case where capacitor 13*a* of the R pixel is set to 1.0 pF, capacitor 13*a* of the G pixel may be set to 1.2 pF, and capacitor 13*a* of the B pixel may be set to 0.9 pF.

A capacity of capacitor 13*c* for a through voltage may be changed in the right and left of the display area. Pixel 10 that is located near gate driver IC 15 or gate driver circuit 16 is disposed on a signal supply side. Therefore, rising of a gate signal is fast, or a slew rate is high, and therefore the through voltage becomes large. Rising of a gate signal of a pixel that is formed at a central part of the display area, or at a position far from gate driver IC 15 and gate driver circuit 16 is slow, and therefore the through voltage becomes small. Therefore, the capacity of capacitor 13*c* for a through voltage of pixel 10 located near a side of connection with gate driver IC 15 is simply made small, and the capacity of capacitor 13*c* of pixel 10 located at the position far from gate driver IC 15 is simply made large.

FIG. 2A to FIG. 2D are operation explanatory diagrams for illustrating operation of the pixel of the EL display device. With reference to FIG. 2A to FIG. 2D, lighting operation of pixel 10 is described more in detail. Operation of writing a video signal in a pixel, and light emission operation of EL element 12 proceed in an order of FIG. 2A, FIG. 2B, FIG. 2C, and FIG. 2D.

Figure 2A:
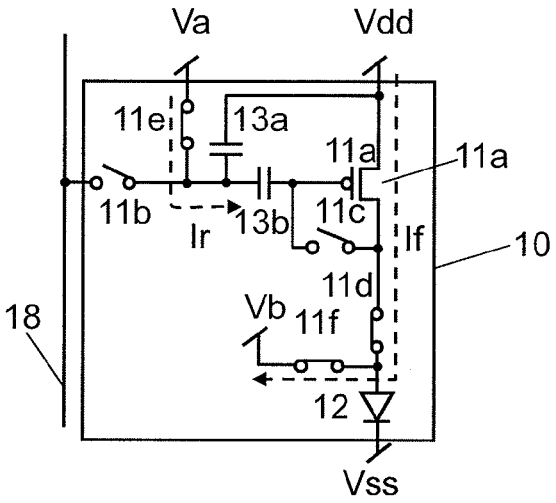
FIG. 2A is an explanatory diagram of initial operation for illustrating operation of the pixel of the EL display device according to the exemplary embodiment.

FIG. 2A is an explanatory diagram of initial operation. After a horizontal synchronizing signal (HD), initialization operation is performed. In FIG. 1, the ON-state voltages are applied to gate signal lines 17*a*, 17*d* and 17*e*, and transistors 11*d*, 11*e* and 11*f* are turned on. The OFF-state voltages are applied to gate signal lines 17*b* and 17*c*, and transistors 11*b* and 11*c* are turned off. Reset voltage Va is supplied to a first end of capacitor 13*a* from a signal line to which reset voltage Va is applied.

Offset cancellation current If flows through transistor 11*a*, from potential Vdd of the source terminal toward DC voltage Vb applied to a drain terminal of transistor 11*f* via channels of transistor 11*a*, 11*c*, 11*f*. The magnitude of the voltages is set to have a relation of anode voltage Vdd>DC voltage Vb, and reset voltage Va>DC voltage Vb.

Offset cancellation current If flows, thereby reducing a drain terminal potential of transistor 11*a*. Additionally, reset current Ir flows by reset voltage Va, and Va voltage is applied to a terminal of capacitor 13*b*.

Transistor 11*a* is turned on, and offset cancellation current If flows for a very short period. At least a drain terminal voltage of transistor 11*a* drops to a lower level than anode voltage Vdd by offset cancellation current If, thereby allowing an operable state.

Figure 2B:
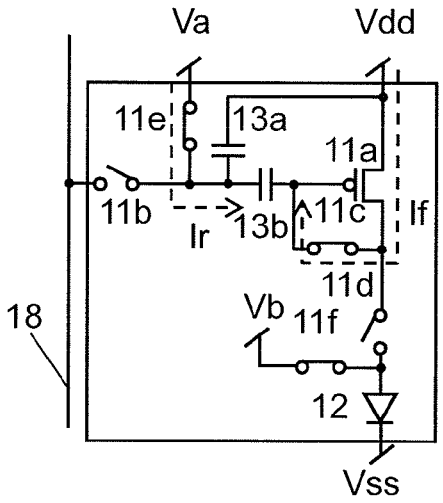
FIG. 2B is an explanatory diagram of reset operation for illustrating operation of the pixel of the EL display device according to the exemplary embodiment.

FIG. 2B shows reset operation. In FIG. 1, the ON-state voltage is applied to gate signal line 17*c*, and the OFF-state voltage is applied to gate signal line 17*d*. Transistor 11*d* is turned off, and transistor 11*c* is turned on.

Transistor 11*d* is turned off, and transistor 11*c* is turned on, so that offset cancellation current If flows toward the gate terminal of transistor 11*a*. Relatively large offset cancellation current If initially flows. As a potential of the gate terminal of transistor 11*a* rises, and is close to an OFF-state, the current that flows is reduced. Finally, the current becomes 0 μA, or a current value near 0 μA.

By the aforementioned operation, transistor 11*a* enters an offset cancellation state. The offset cancellation voltage is held by capacitor 13*b*. Capacitor 13*b* has one terminal held by reset voltage Va. The offset cancellation voltage is held by the other terminal (terminal connected to the gate terminal of transistor 11*a*).

Figure 2C:
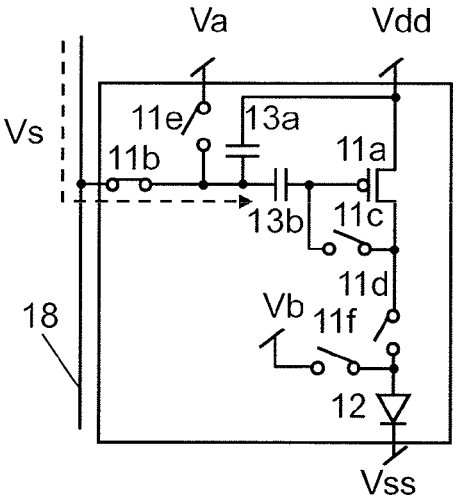
FIG. 2C is an explanatory diagram of program operation for illustrating operation of the pixel of the EL display device according to the exemplary embodiment.

FIG. 2C shows program operation. In FIG. 1, during program operation, the OFF-state voltages are applied to gate signal lines 17*a*, 17*c* and 17*d*, and transistors 11*e*, 11*c* and 11*d* are turned off. The ON-state voltage is applied to gate signal line 17*b*, and transistor 11*b* is turned on.

On the other hand, video signal voltage Vs is applied to source signal line 18. Transistor 11*b* is turned on, so that video signal voltage Vs is applied to capacitor 13*b*. The voltage of terminal of capacitor 13*b* is changed from reset voltage Va to video signal voltage Vs. Therefore, a voltage based on video signal voltage Vs+offset cancellation voltage is held by capacitor 13*b*.

Video signal voltage Vs is a voltage based on anode voltage Vdd. Anode voltage Vdd is different in the panel by wiring voltage drop in the panel. Therefore, video signal voltage Vs is also variable or changed on the basis of anode voltage Vdd applied to the pixel.

Figure 2D:
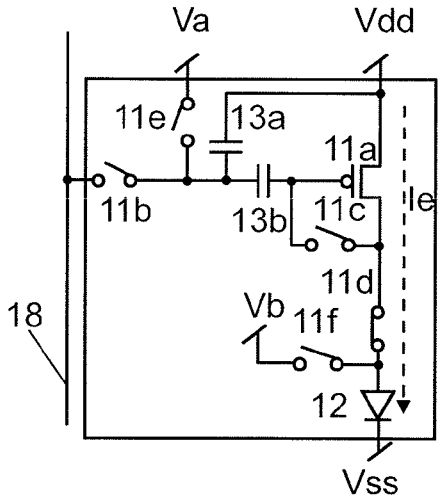
FIG. 2D is an explanatory diagram of light emission operation for illustrating operation of the pixel of the EL display device according to the exemplary embodiment.

FIG. 2D shows light emission operation of EL element 12. After the program operation in FIG. 2C, in FIG. 1, the OFF-state voltage is applied to gate signal lines 17*b*, and transistor 11*b* enters the OFF-state. Pixel 10 is separated from source signal line 18. The ON-state voltage is applied to gate signal line 17*d*, transistor 11*d* is turned on, light emitting current Ie from transistor 11*a* is supplied to EL element 12. EL element 12 emits light on the basis of supplied light emitting current Ie.

In FIG. 1, and FIG. 2A to FIG. 2D, transistor 11*f* may be deleted. In a pixel configuration in which transistor 11*f* is not included, in FIG. 2A, when transistor 11*d* is turned on, offset cancellation current If flows through EL element 12. Offset cancellation current If flows through EL element 12, so that EL element 12 emits light. However, time during which offset cancellation current If flows is 1 μsec or less, and therefore time during EL element 12 emits light is very short. Accordingly, contrast of EL display device (EL display panel) is hardly reduced.

Source driver IC 14 that serves as a source driver circuit may be incorporated with not only a mere driver function, but also a power supply circuit, a buffer circuit (including a circuit such as a shift resister), a data conversion circuit, a latch circuit, command data, a shift circuit, an address conversion circuit, an image memory, and the like.

Gate driver circuit 16 may configure a shift register and an output buffer circuit by use of the P-channel transistors, and the capacitors. Only the P-channel transistors are configured, so that the number of masks to be used in a process is reduced, and the panel can be implemented at a low cost.

Transistors 11*a* to 11*f* may be formed by any of formation methods by high temperature polysilicon, low temperature polysilicon, continuous grain boundary silicon, transparent amorphous oxide semiconductor, amorphous silicon, infrared RTA, and the like. These transistors have top gate structures, so that parasitic capacities are reduced, and gate electrode patterns of top gates become light shielding layers, and light emitted from EL element 12 is shielded by the light shielding layers. Consequently, it is possible to reduce incorrect operation of the transistors, and an off-leakage current.

As a wiring material of gate signal line 17 or source signal line 18, or wiring materials of both of gate signal line 17 and source signal line 18, a material that allows implementation of a process capable of employing copper wiring or copper alloy wiring is preferable, because wiring resistance can be reduced, and a large EL display panel can be implemented.

Thus, in the present disclosure, gate driver circuit 16 that is incorporated in EL display panel 1, and gate driver IC 15 that is not incorporated in EL display panel 1 are used, gate driver circuit 16 is used in order to control a current supplied to EL element 12, and gate driver IC 15 is used in order to control transistor 11*b* which applies a video signal to pixel 10. Detailed description is made later.

A configuration of the EL display panel is now described.

Figure 3:
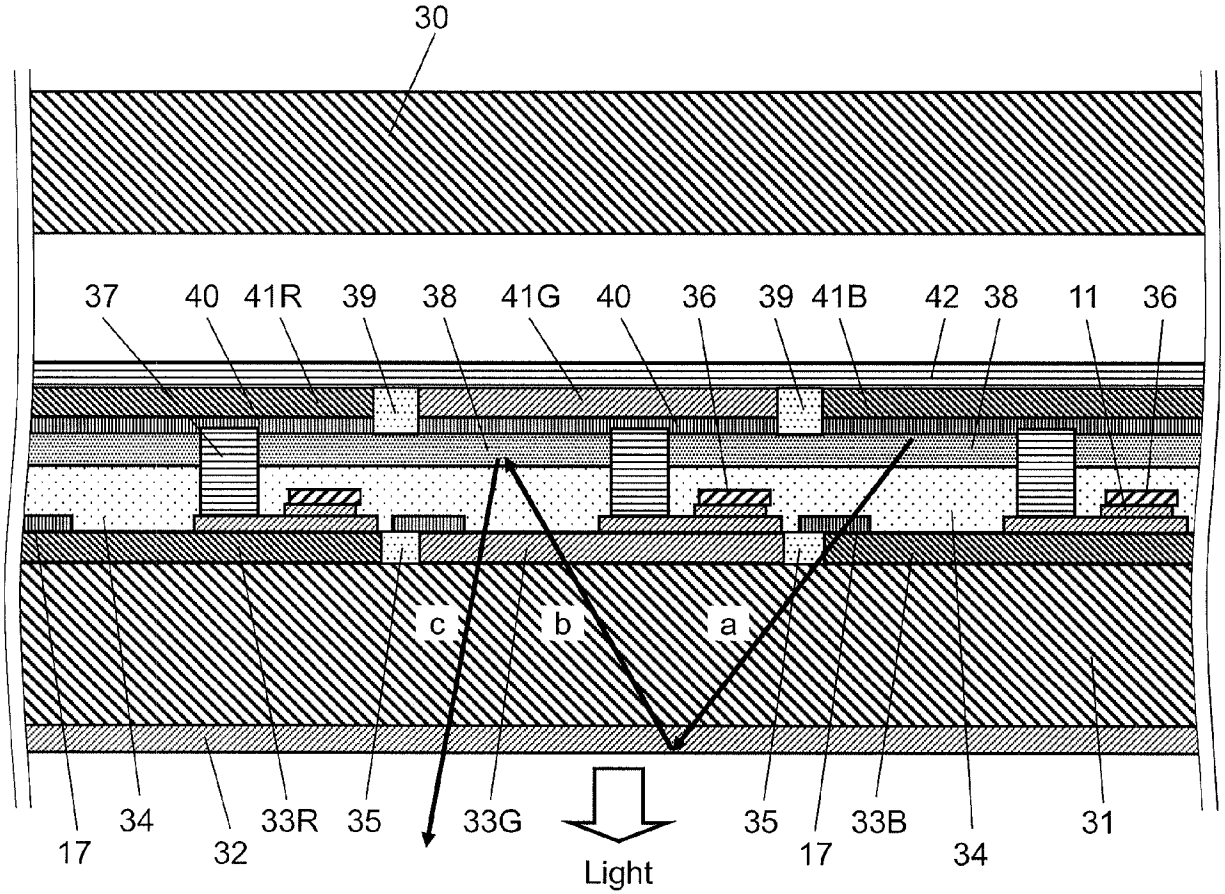
FIG. 3 is a sectional view showing an example of the EL display panel of the EL display device according to the exemplary embodiment.

FIG. 3 is a sectional view showing an example of the EL display panel. As shown in FIG. 3, sealing plate 30 is disposed on a back surface side of the EL display panel, array substrate 31 is disposed on a front surface side, and polarizing plate 32 is disposed on a display surface of array substrate 31. As a constituent material of array substrate 31, a glass substrate, silicon wafer, a metal substrate, a ceramic substrate, a plastic sheet, or the like that has optical transparency, or sapphire glass for making heat dissipation favorable is used. As a constituent material of sealing plate 30, a material similar to that of array substrate 31 is used. A drying agent (not shown) is disposed in a space between sealing plate 30 and array substrate 31, in order to prevent deterioration of an EL material that is weak to humidity. Sealing plate 30 and array substrate 31 have peripheries that is are sealed by sealing resin (not shown).

A temperature sensor (not shown) is disposed in a space between sealing plate 30 and array substrate 31, on a surface of sealing plate 30, or the like and duty ratio control, lighting rate control of the EL display panel, or the like is performed by an output result of this temperature sensor. Furthermore, during panel inspection, an operating speed of the gate driver circuit is adjusted on the basis of detection output of the temperature sensor.

A thin film transistor array substrate side is described at first. In FIG. 3, color filters 33 (33R, 33G, 33B) configured from red (R), green (G), blue (B) are formed on an inner surface of array substrate 31. The color filters are not limited to RGB, and pixels of cyan (C), magenta (M), yellow (Y) may be formed. Additionally, a pixel of while (W) may be formed. A single pixel for performing color display is prepared such that 3 pixels of RGB are formed in a square. Aperture ratios of R, G and B pixels may be different. The aperture ratios are made different, so that densities of currents that flow through EL elements 12 of the respective pixels of RGB can be made different. Consequently, deterioration speeds of EL elements 12 of RGB can be made the same.

The method of performing color display in the EL display panel includes a method of forming a blue light emitting EL layer, and converting the emitted blue light into R, G and B light with R, G and B color conversion layers, in addition to a method using color filters 33 as described above.

As shown in FIG. 1, each pixel formed on array substrate 31 has a plurality of transistors 11, and gate signal lines 17 are disposed between the pixels. Insulation film 34 that serves as an interlayer insulation film is formed on color filters 33 so as to cover transistors 11, gate signal lines 17, and source signal lines (not shown). Furthermore, black matrixes 35 are formed between color filters 33, and light shielding films 36 are formed on parts that form transistors 11. Additionally, connection parts 37 for connecting transistors 11 on a side of array substrate 31 and pixel electrodes on a side of a light emission part are disposed inside insulation film 34. Furthermore, light scattering layer 38 is formed on insulation film 34. This light scattering layer 38 may be configured by a resin material that includes titanium oxide, aluminum oxide, magnesium oxide or the like, each of which is diffused, or a light diffusing material such as opal glass. Light scattering layer 34 contributes to increase of light radiated from the panel.

A light emission part side is described below. In FIG. 3, ribs 39 are formed on insulation film 34 so as to separate the respective pixels, and anode electrodes 40 configured from transparent electrodes such as ITO, IGZO and IZO, and EL layers 41R, 41G and 41B of red (R), green (G) and blue (B) are formed in ribs 39. Then, cathode electrode 42 is formed on EL layers 41R, 41G and 41B such that EL layers 41R, 41G and 41B are sandwiched between cathode electrode 42 and anode electrodes 40.

As cathode electrode 42, silver (Ag), aluminum (Al), magnesium (Mg), calcium (Ca), or these alloys, a transparent electrode such as ITO, IGZO and IZO can be used.

Herein, an example shown in FIG. 3 is an example of a configuration in which light is extracted from the side of array substrate 31. However, as shown in FIG. 4, an EL display panel having a configuration in which light is extracted from the light emission part side may be used.

Figure 4:
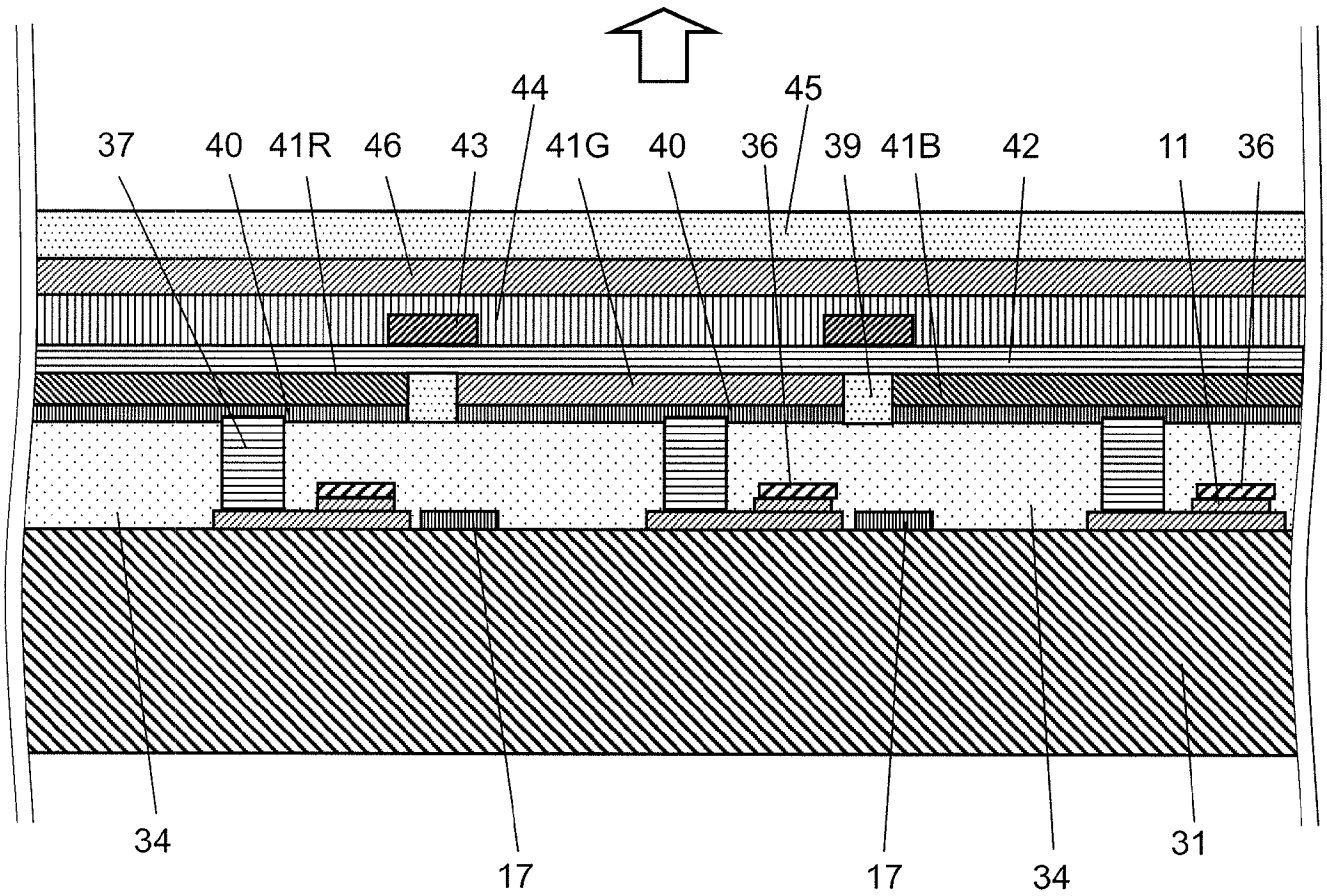
FIG. 4 is a sectional view showing another example of the EL display panel of the EL display device according to the exemplary embodiment.

In a panel of an example shown in FIG. 4, low resistance wires 43 configured from a layered structure of metal selected from among chrome (Cr), aluminum (Al), titanium (Ti) and copper (Cu), or an alloy metal thin film of a plurality of metal materials are formed on an upper layer or a lower layer of cathode electrode 42. Then, after cathode electrode 42 is covered with sealing film 44, including low resistance wires 43, a glass substrate or sealing substrate 45 configured from a film having optical transparency is adhered by adhesive layer 46.

A configuration of the EL display device and an inspection method in production are described below.

Figure 5:
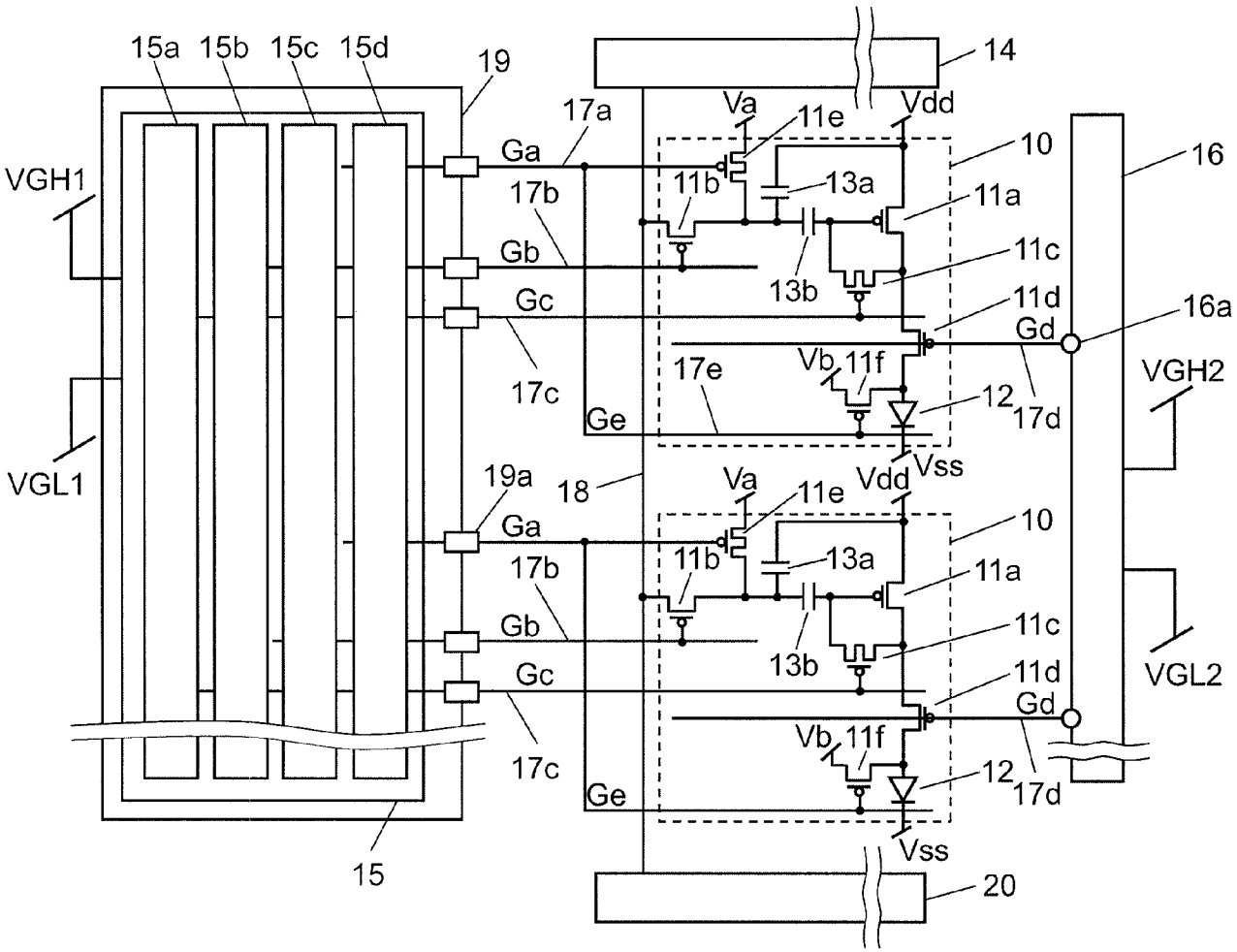
FIG. 5 is a configuration diagram showing a connection state of gate signal lines of the EL display device according to the exemplary embodiment.

FIG. 5 is a configuration diagram showing a connection state of the gate signal lines in the EL display device. FIG. 5 shows only 2 pixels, and capacitors 13*c* to 13*e* shown by the dotted lines in FIG. 1 are omitted from FIG. 5.

As shown in FIG. 5, gate terminals of transistors 11*b* are connected to gate signal lines 17*b* (Gb), gate signal lines 17*b* (Gb) are connected to gate driver IC 15, or terminal electrodes 19*a* of COF 19. Gate terminals of transistors 11*e* are connected to gate signal lines 17*a* (Ga), and gate terminals of transistors 11*f* are connected to gate signal lines 17*e* (Ge). The gate terminals of transistors 11*c* are connected to gate signal lines 17*c* (Gc). Each gate signal lines 17*e* is connected to one gate signal line 17*a* (Ga), and is connected to terminal electrode 19*a* of COF 19 that is mounted with gate driver IC 15. Therefore, two transistors (11*e*, 11*f*) are connected to gate signal line 17*a* (Ga). Gate driver IC 15 outputs an ON/OFF voltage to gate signal lines 17*a*, and performs on/off control of transistors 11*e* and 11*f*. Additionally, gate driver IC 15 sequentially or individually controls each pixel row, and displays an image on the panel.

Like gate signal lines 17*b* of transistors 11*b*, video signals are applied to pixels 10, and gate signal lines that control transistors necessary for high-speed writing are connected to external gate driver IC 15. In a case where a plurality of the transistors are connected to a single gate signal line like each gate signal line 17*a*, the gate signal line is connected to external gate driver IC 15.

On the other hand, like gate signal lines 17*d* of transistors 11*d*, the gate signal lines that control light emitting currents supplied to EL elements 12 from driving transistors 11*a* are connected to gate driver circuit 16 that is incorporated in the panel.

In FIG. 5, gate driver IC 15 is provided with three shift register circuits 15*a*, 15*b* and 15*c*, and output buffer circuit 15*d*. Although not shown in FIG. 5, outputs of shift register circuits 15*a*, 15*b* and 15*c* are led out to outside, and shift register circuits 15*a*, 15*b* and 15*c* are connected to control signal lines to which clock signals CK or start pulse signals ST are supplied.

Herein, gate signal lines 17 (gate signal lines 17*a*, 17*b*, 17*c*, 17*e*) that are driven (controlled) by gate driver IC 15, and need high-speed response are formed of three layers of copper (Cu), or titanium (Ti)-copper (Cu)-titanium (Ti), or copper (Cu) alloy such that resistance values are reduced. On the other hand, gate signal lines 17 (gate signal lines 17*d*) driven by gate driver circuit 16 do not need relatively high-speed response, and therefore are configured by aluminum (Al), molybdenum (Mo), tungsten (W), or alloy of these metals that allow relatively high impedance.

That is, gate signal lines 17 controlled by external gate driver IC 15 are each configured by such a metal material that wiring resistance is lower than that of gate signal line 17 controlled by incorporated gate driver circuit 16. The method of reducing wiring resistance may be not a method of changing a metal material itself, but a method of changing a film thickness or a width of wiring.

Figure 6:
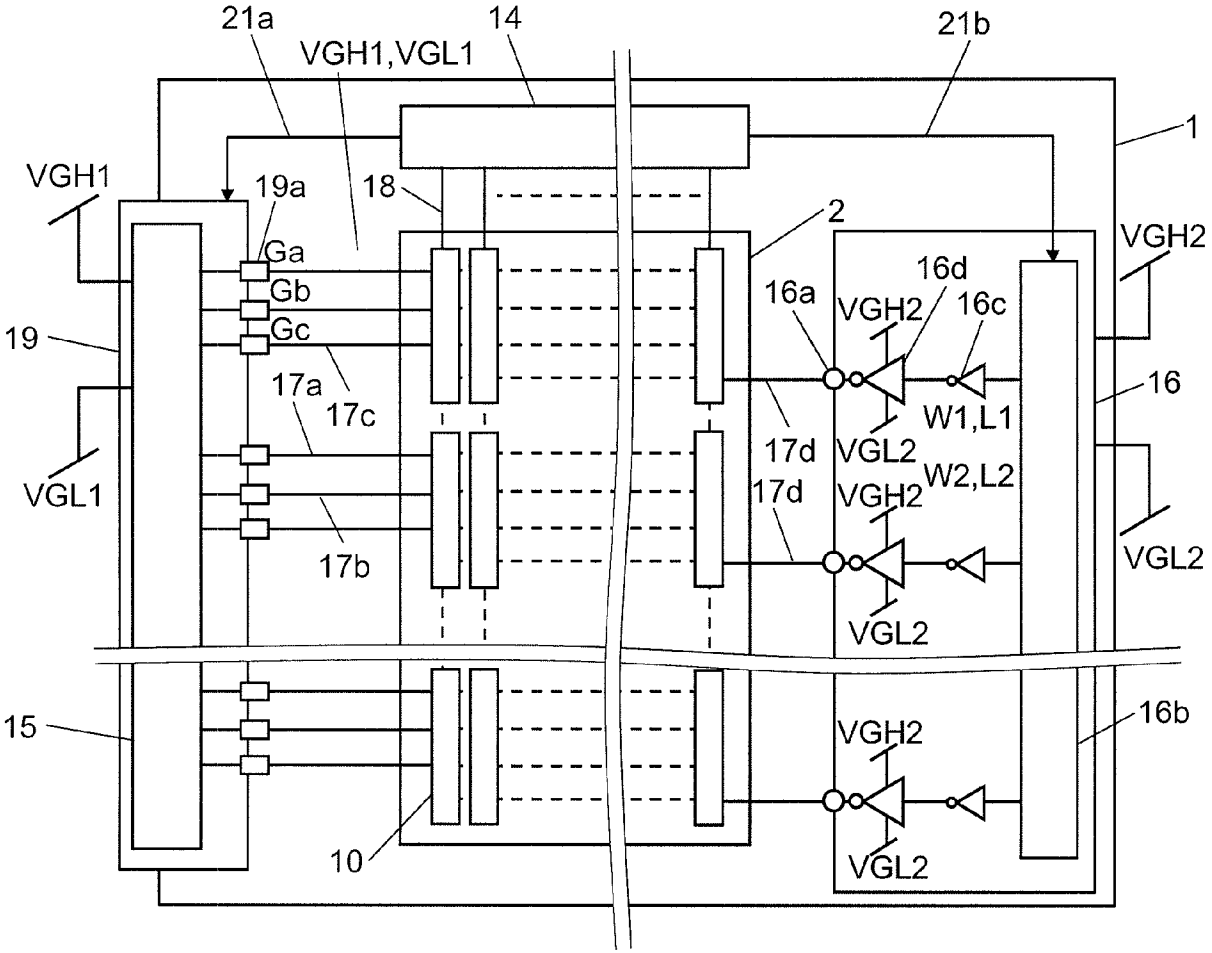
FIG. 6 is a configuration diagram of an incorporated gate driver circuit side of the EL display device according to the exemplary embodiment.

FIG. 6 is a configuration diagram showing a configuration of an incorporated gate driver circuit side, and a connection state with a plurality of the pixels in the EL display device. In FIG. 6, gate signal lines 17*e* are commonly connected to gate signal lines 17*a* as shown in FIG. 5, and omitted. Additionally, in FIG. 6, reference numeral 2 denotes the display area of EL display panel 1.

As shown in FIG. 6, gate driver circuit 16 outputs ON/OFF voltages (VGH2, VGL2) to gate signal lines 17*d*, and gate driver IC 15 outputs ON/OFF voltages (VGH1, VGL1) to gate signal lines 17*a*, 17*b* and 17*c*. Output voltages VGH1, VGH2, VGL1 and VGL2 of gate driver IC 15 and gate driver circuit 16 are independently set to voltage values suitable for the respective transistors of each pixel 10. Gate driver circuit 16 is provided with shift register circuit 16*b*, and at least two stages of inverter circuits 16*c* and 16*d*, and control signal lines 21*a* and 21*b* that supply clock signals CK or start pulse signals ST are connected to shift register circuits 16*a* of gate driver circuit 16, shift register circuits 15*a*, 15*b* and 15*c* of gate driver IC 15 shown in FIG. 5, and source driver IC 14.

Herein, gate driving ability of an output stage of shift register circuit 16*b* is small, and therefore gate driver circuit 16 is incapable of directly driving gate signal lines 17*d* with gate circuits that configure shift register circuits 16*b*. Accordingly, it is necessary to connect inverter circuits 16*c* and 16*d* in stages. When the number of connection stages of inverter circuits 16*c* and 16*d* are large, characteristic differences of connected inverter circuits 16*c* and 16*d* are accumulated, thereby causing a difference in transmission time from shift register circuit 16*b* to terminal electrode 16*a*. For example, in an extreme case, an ON/OFF signal is output to terminal electrode 16*a* in 1.0 μsec after an output pulse is output from shift register circuit 16*b*.

Specifically, in FIG. 6, in a case where a channel width of an N-channel transistor of each inverter circuit 16*c* is set to W1, a channel length is set to L1, a channel width of an N-channel transistor of each inverter circuit 16*d* is set to W2, and a channel length is set to L2, when a size ratio of a size of W2/L2 of inverter circuit 16*d* to a size of W1/L1 of inverter circuit 16*c* is large, delay time is increased, and variation in inverter characteristics becomes large.

Figure 7:
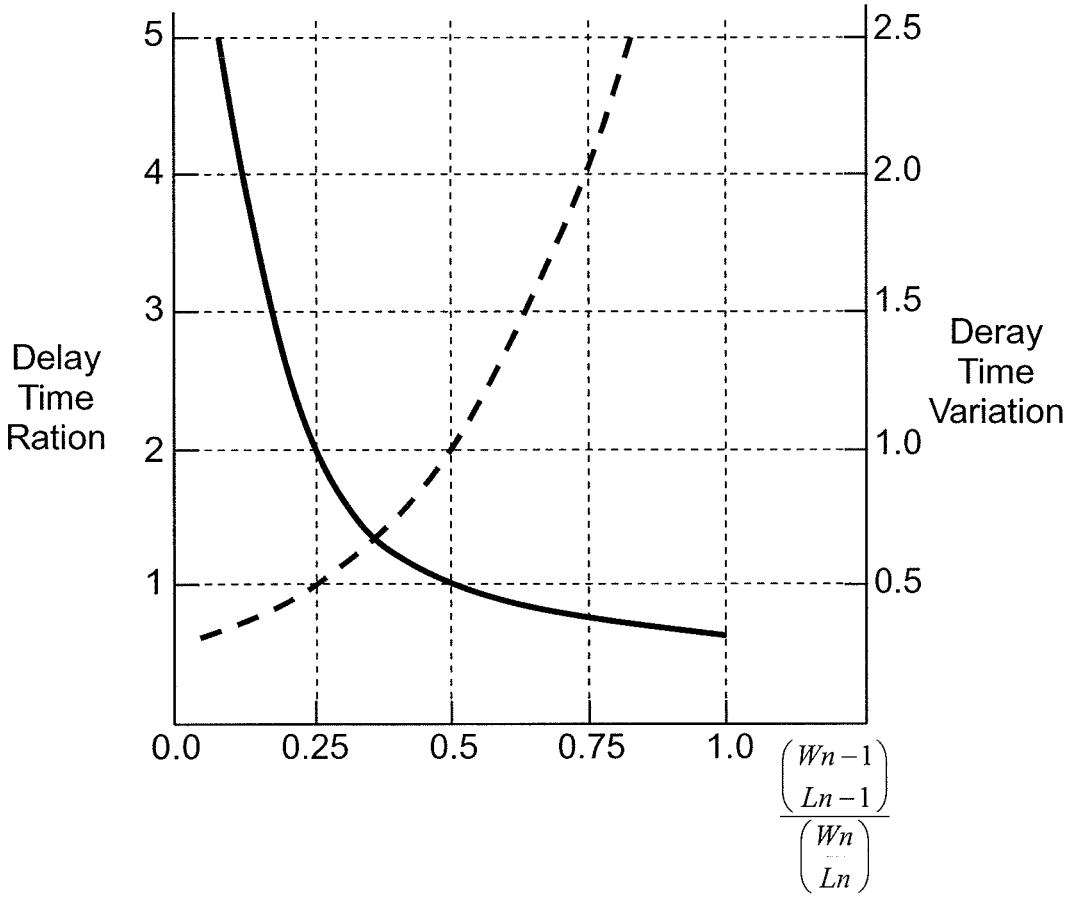
FIG. 7 is a diagram showing a relation between delay time variation (dotted line) and a delay time ratio (solid line).

FIG. 7 is a diagram showing a relation between delay time variation (dotted line) and a delay time ratio (solid line). A horizontal axis is shown by (Wn−1/Ln−1)/(Wn/Ln). For example, in FIG. 6, when L of inverter circuit 16*d* and L of inverter circuit 16*c* are the same (L1=L2), and 2·W1=W2 is satisfied, (W1/L1)/(W2/L2)=0.5 is satisfied. In a graph of FIG. 7, when (Wn−1/Ln−1)/(Wn/Ln)=0.5 is satisfied, the delay time ratio is 1, and similarly, the delay time variation is 1.

As shown in FIG. 7, the larger (Wn−1/Ln−1)/(Wn/Ln) is, the larger the delay time variation of the inverter circuit part is. The smaller (Wn−1/Ln−1)/(Wn/Ln) is, the longer the delay time from inverter circuits 16*c* to next stage of inverter circuit 16*d* is. As apparent from FIG. 7, it is advantageous in design that the delay time ratio and the delay time variation are set within 2. Therefore, the following formula should be satisfied.

$$0.25 \leq (Wn-1/Ln-1)/(Wn/Ln) \leq 0.75$$

Additionally, a W/L ratio of a P-channel of each of inverter circuits 16*c* and 16*d* (Wp/Lp) and a W/L ratio of an n-channel (Ws/Ls) needs to satisfy the following relation.

$$0.4 \leq (Ws/Ls)/(Wp/Lp) \leq 0.8$$

Figure 8:
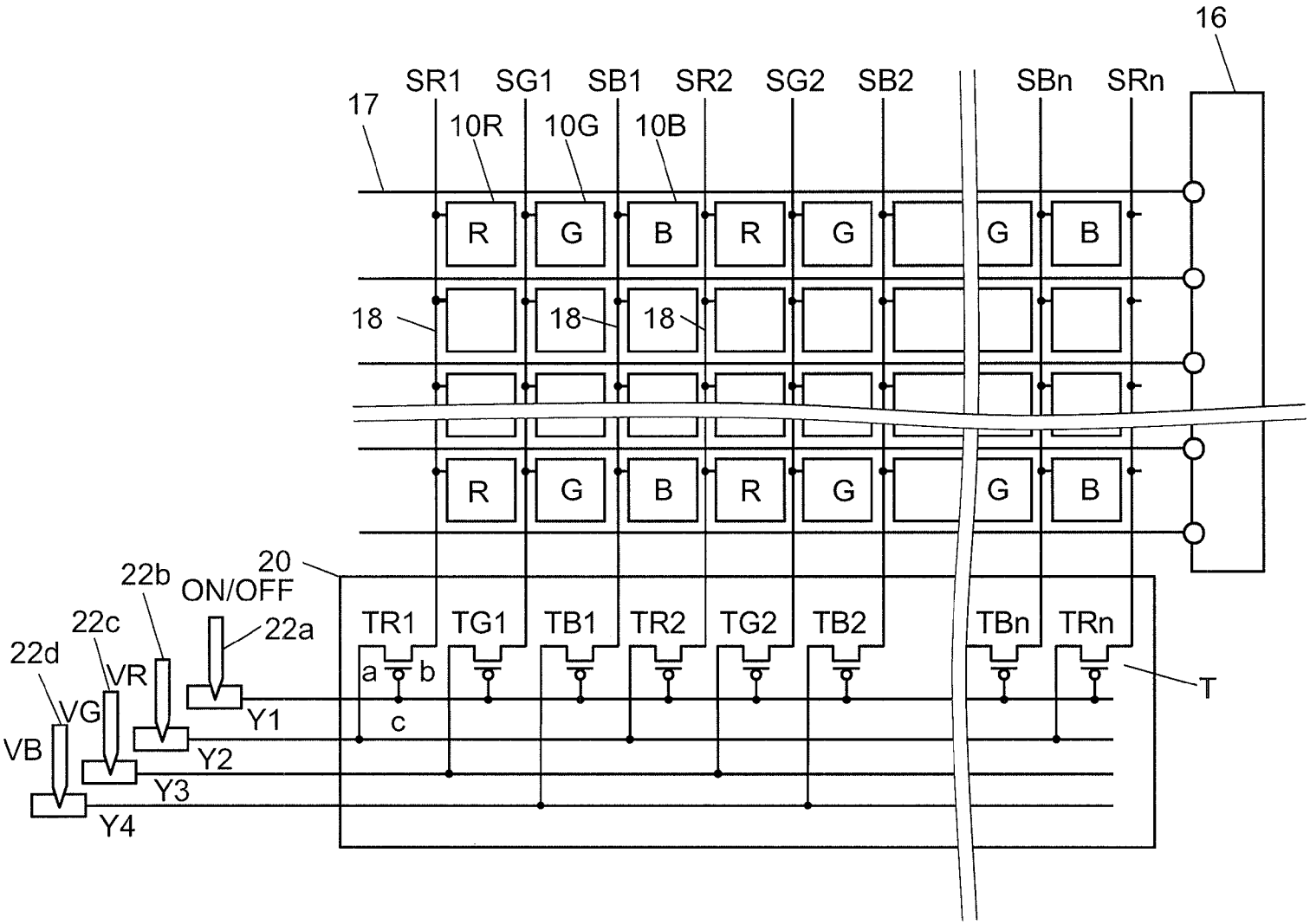
FIG. 8 is a configuration diagram showing a configuration of a test circuit of the EL display device according to the exemplary embodiment.

FIG. 8 is a configuration diagram showing a configuration of the test circuit in the EL display device.

As shown in FIG. 8, test circuit 20 is connected to an end of each source signal line 18, and test transistors T (transistors TR1, TG1, TB1 . . . TRn, TGn, TBn) that are connected to the ends of source signal lines 18 of respective pixels 10R, 10G and 10B of RGB are connected inside test circuit 20.

Test transistors T are transistors (switch circuits) for application of red (R), green (G), and blue (B) voltage, and switching transistors for sequentially applying voltages to respective pixels 10R, 10G and 10B of RGB. Gate terminals of transistors T are connected to electrode terminals Y1 to Y4, and probes 22*a* to 22*d* are connected to electrode terminals Y1 to Y4, and ON/OFF voltages of transistors T are applied. On/off control of transistors T is performed on the basis of the voltages applied to electrode terminals Y1 to Y4. The ON/OFF voltages applied to electrode terminals Y1 to Y4 each are a voltage equivalent to the video signal voltage. For example, ON-state voltage is applied with OFF-state voltage VGH, and ON-state voltage VGL, so that transistors T are turned on, and a test voltage is applied to each pixel 10. That is, magnitude of a test voltage is varied, so that display luminance of pixel 10 can be changed.

A the time of a test of EL display panel 1, an ON-state voltage is applied to probe 22*a*, transistors T are turned on, and a test voltage is applied to each source signal line 18. At the time of the test, gate driver circuit 16 is operated, and a gate signal line position to be selected is moved, thereby performing inspection. Additionally, gate driver IC 15 is operated as necessary, thereby performing inspection.

Thus, at the time of the test, test circuit 20 and gate driver circuit 16 are controlled at the same time, and panel inspection is performed, thereby obtaining effects of facilitating panel inspection, and rapidly performing accurate inspection.

In order to perform black display of pixel 10, when driving transistor 11*a* of the pixel is a P-channel driving transistor, the test voltage is generally set to a voltage value near anode voltage Vdd. In order to perform white display, the test voltage is generally set to a ground voltage or a voltage value near cathode voltgage Vss.

Figure 9:
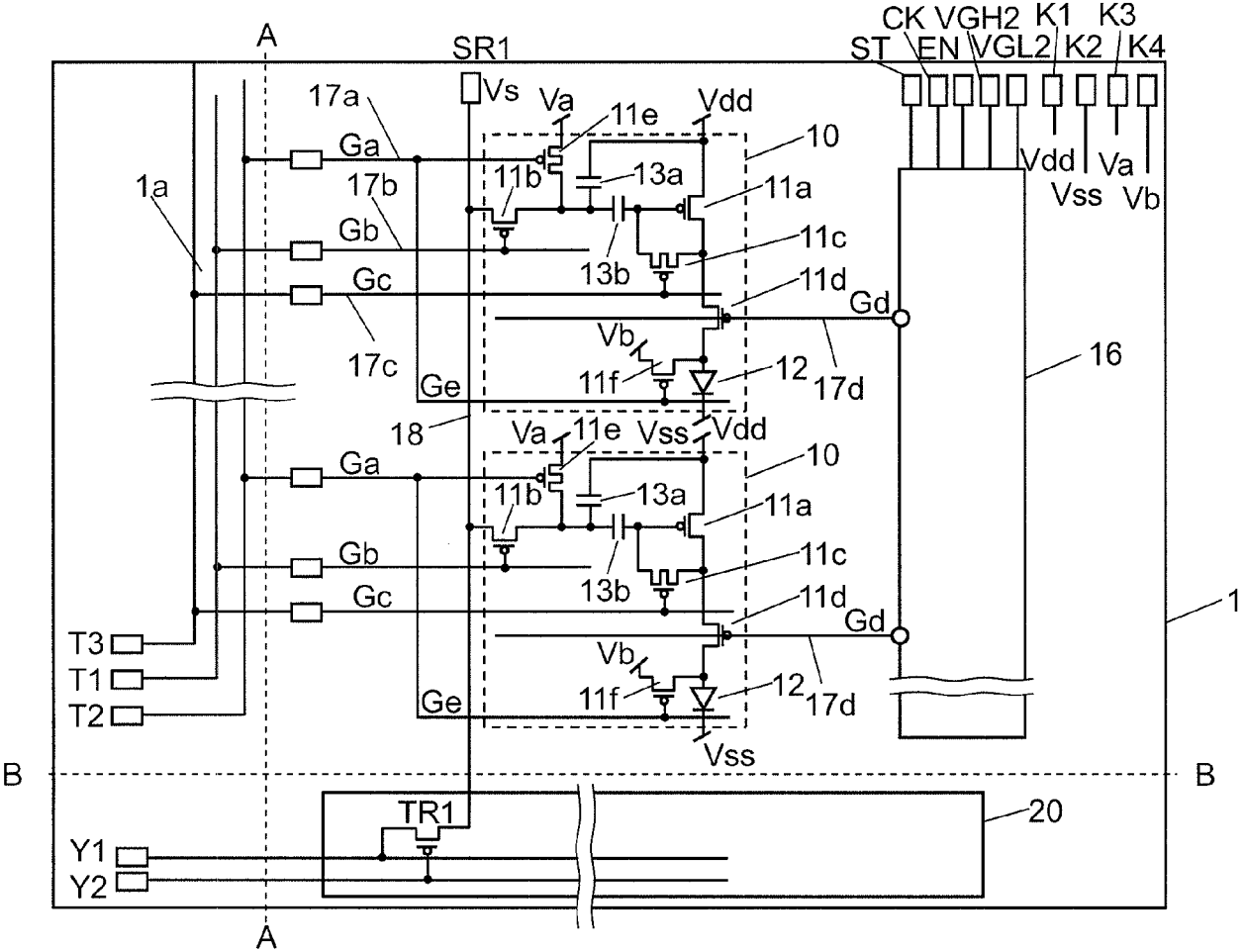
FIG. 9 is an explanatory diagram of an inspection method of the EL display panel of the EL display device according to the exemplary embodiment.

FIG. 9 is an explanatory diagram for illustrating an inspection method of the EL display panel in a production method of the EL display device. FIG. 9 schematically shows a wiring state in inspection.

As shown in FIG. 9, ends of gate signal lines 17*a*, 17*b* and 17*c* connected to externally connected gate driver IC 15 are connected to a T1 terminal, a T2 terminal and a T3 terminal via wires 1*a* formed on an end of EL display panel 1. That is, the T1 terminal is connected to gate signal lines 17*b* (Gb) of a plurality of pixels 10, the T2 terminal is connected to gate signal lines 17*a* of a plurality of pixels 10, and the T3 terminal is connected to gate signal lines 17*c* of a plurality of pixels 10. As described above, gate driver circuit 16 incorporated in EL display panel 1 is connected to gate signal lines 17*d*. As described in FIG. 8, the ends of source signal lines 18 are connected to test circuit 20.

In FIG. 9, the ON-state voltage (VGL1) or the OFF-state voltage (VGH1) is applied to the T1 terminal, so that on/off control of transistors 11*b* of pixels 10 can be performed, and video signals applied to source signal lines 18 can be written in pixels 10. Additionally, the ON-state voltage (VGL1) or the OFF-state voltage (VGH1) is applied to the T2 terminal, so that on/off control of transistors 11*e* and 11*f* of pixels 10 can be performed, and reset voltages Va can be applied to pixels 10. Furthermore, the ON-state voltage (VGL1) or the OFF-state voltage (VGH1) is applied to the T3 terminal, so that on/off control of transistors 11*c* of pixels 10 can be performed, and reset voltages Va are applied to pixels 10, and transistors 11*c* are turned on, thereby enabling offset cancellation operation.

As shown in FIG. 9, predetermined test signals are supplied to gate signal lines 17*a*, 17*b* and 17*c* via the T1 terminal, the T2 terminal and the T3 terminal, predetermined test signals are supplied to gate signal lines 17*d* from incorporated gate driver circuit 16, and predetermined test signals are supplied to source signal lines 18 via test circuit 20. In selection of gate signal lines 17*d* by gate driver circuit 16, a plurality of gate signal lines 17*d* may be selected at the same time. Selection of gate signal lines 17*d* can be set by start signal (ST) applied to gate driver circuit 16.

After the inspection of EL display panel 1 is thus performed, the substrate of EL display panel 1 is cut with A-A line and B-B line of FIG. 9, and wires 1*a* and test circuit 20 are separated, so that the inspection of EL display panel 1 can be rapidly performed with a simple configuration.

After the inspection, voltages that allow the transistors in test circuit 20 to be turned off are always applied to test circuit 20, so that the substrate of EL display panel 1 may not be cut with B-B line. Also on the side of gate signal lines 17*a*, 17*b* and 17*c*, the T1 terminal, the T2 terminal and the T3 terminal are not provided, and probes for inspection are electrically brought into direct contact with gate signal lines 17*a*, 17*b* and 17*c* to allow supply of the predetermined test signals, so that the cutting of the substrate after the inspection is not needed.

Figure 10:
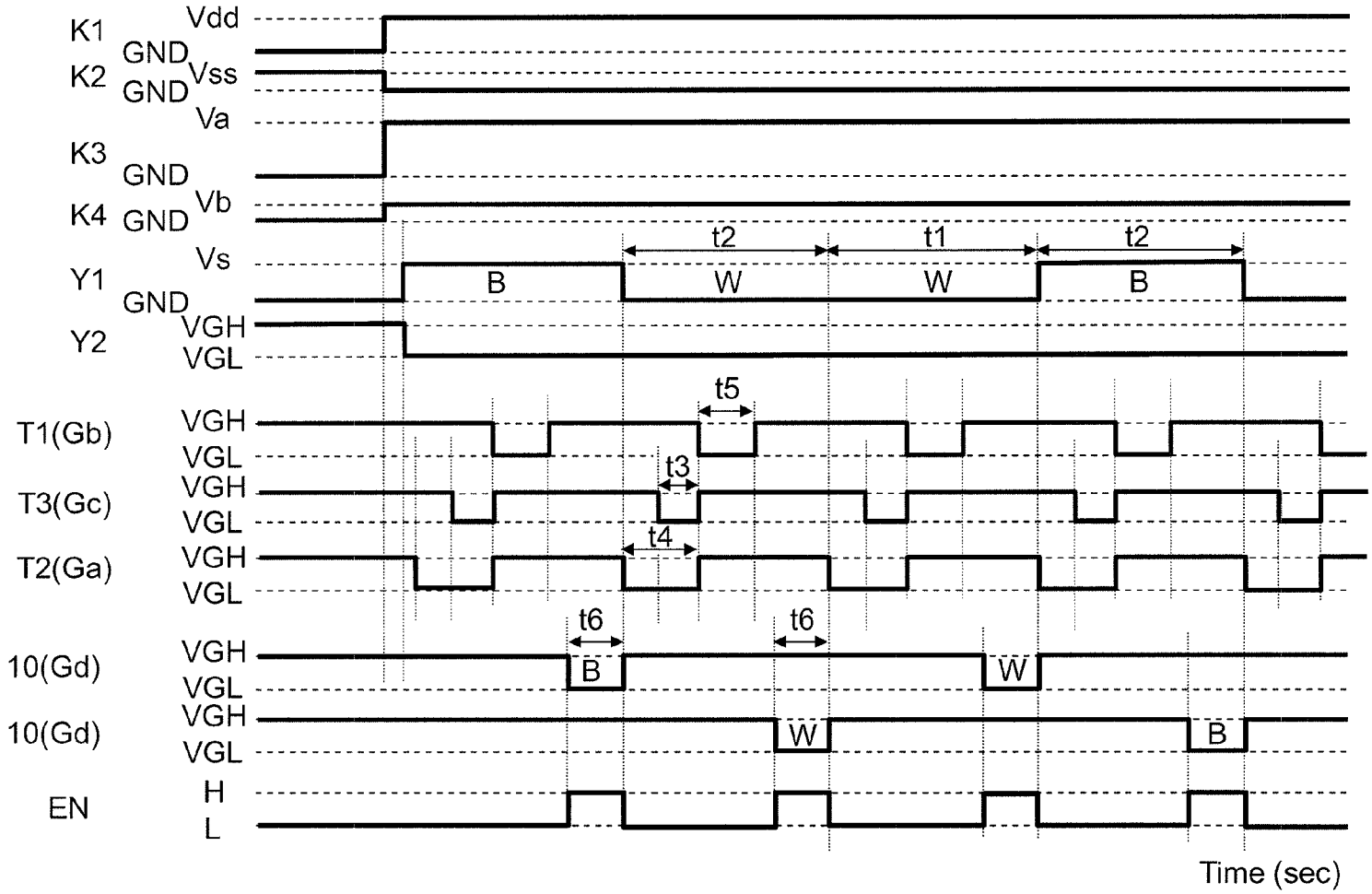
FIG. 10 is a diagram showing a voltage waveform supplied to a main part of FIG. 9.

FIG. 10 is a diagram showing voltage waveform supplied to a main part of FIG. 9. In FIG. 10, reference code B denotes low luminance (black display), and reference code W denotes high luminance (white display).

As shown in FIG. 10, anode voltage Vdd is applied to a K1 terminal of FIG. 9, cathode voltgage Vss is applied to a K2 terminal, reset voltage Va is applied to a K3 terminal, and voltage Vb is applied to a K4 terminal. VGH2 voltage of gate driver circuit 16 is applied to a VGH2 terminal, a VGL2 voltage is applied to a VGL2 terminal. Clock CK of gate driver circuit 16 is applied to a CK terminal, start signal ST is applied to an ST terminal, and enable signal EN is applied to an EN terminal.

A probe for inspection is brought into the T1 terminal, the ON/OFF voltages (VGL, VGH) are applied to gate signal lines 17*b*, so that on/off control of transistors 11*b* is performed. The ON/OFF voltages (VGL, VGH) are applied to gate signal lines 17*a* from the T2 terminal, so that on/off control of transistors 11*e* and 11*f* is performed. The ON/OFF voltages (VGL, VGH) are applied to gate signal lines 17*c* from the T3 terminal, so that on/off control of transistors 11*c* is performed.

ON/OFF signal voltages of the transistors of test circuit 20 are applied to a Y2 terminal. The transistors of test circuit 20 is P-channel transistors, and the VGL voltage is applied to the Y2 terminal, thereby turning on the transistors. Video signal voltage Vs is applied to a Y1 terminal, an appropriate voltage according to a video signal is applied to each of red (R), green (G), and blue (B) pixels. This voltage applied to each pixel is intermittently applied, so that RGB pixels of EL display panel 1 can be intermittently lit.

The inspection method is described with the example in which EL elements 12 are brought into lighting states or non-lighting states, and inspection is performed. However, a current that flows through a short circuit part is detected, thereby enabling inspection of short circuit defects of transistors 11 or the like. The detection of the current that flows through the short circuit part may employ a method of bringing a probe for pickup into contact with source signal lines 18 or the like, and detecting the current.

Video signal voltage Vs is made variable, so that light emission luminance of the pixels can be changed. Driving transistors 11*a* of pixels 10 are P-channel transistors, and therefore video signal voltage Vs is made to be a voltage near anode voltage Vdd so that light emission luminance of pixels 10 becomes low. On the other hand, video signal voltage Vs is made to be a voltage near ground or cathode voltgage Vss, so that light emission luminance of pixels 10 becomes high. As a matter of course, video signal voltage Vs is adjusted or is made variable, so that light emission luminance of EL elements 12 of pixels 10 can be adjusted.

As shown in FIG. 10, voltages that cause low luminance and high luminance are applied to the Y1 terminal during t1+t2 periods that are defined as one cycle, a t1 period and a t2 period are independently made variable, or the t1 period or the t2 period with respect to the t1+t2 periods is made variable, so that holding characteristics of capacitors 13 of pixels 10 or the like can be inspected. Additionally, light emission characteristics of EL elements 12 and characteristics of transistors 11 can be inspected.

The VGL voltage is applied to the T2 terminal during a t4 period, so that transistors 11*e* and 11*f* connected to gate signal lines 17*a* (Ga) are turned on. Additionally, ON-state voltages VGL are applied to gate signal lines 17*d* (Gd), so that transistors 11*d* are turned on. Transistors 11*d* and transistors 11*f* are turned on, so that current paths of anode voltages Vdd→transistors 11*a*→transistors 11*d*→transistors 11*f*→Vb terminals are generated, the drain terminals of driving transistors 11*a* are lowered.

The VGL voltage is applied to the T3 terminal during t3, so that transistors 11*c* connected to gate signal lines 17*c* (Gc) are turned on, and offset cancellation of transistors 11*a* is performed. Then, the VGH voltages are applied to the T2 terminal and the T3 terminal, and transistors 11*e*, 11*f* and 11*c* are turned on. The VGL voltage is applied to the T1 terminal during a t5 period, so that transistors 11*b* connected to gate signal lines 17*b* are turned on. Transistors 11*b* are turned on, so that video signals are applied to pixels 10.

The t3, t4 and t5 periods are made variable or adjusted, so that offset cancellation operation of pixels 10 can be performed. Additionally, application time of reset voltage Va is made variable, so that operation states of transistors 11 can be changed or adjusted, and an operation test of pixels 10 can be performed.

Control of emission (ON) and non-emission (OFF) of EL elements 12 of pixels 10 is performed with a signal supplied to an enable terminal (EN terminal) of gate driver circuit 16 incorporated in the panel. When the EN terminal is set to an H level in a logic level, the VGL voltage is output to gate signal line 17*d* (Gd), and transistor 11*d* is turned on. Transistor 11*d* is turned on, so that a current path, which allows a light emitting current from driving transistor 11*a* to be supplied to EL element 12, is generated, and corresponding EL element 12 emits light. When the EN terminal is set to an L level in the logic level, the VGH voltage is output to gate signal line 17*d* (Gd), and transistor 11*d* is turned off. Transistor 11*d* is turned off, so that the current path, which allows the light emitting current from driving transistor 11*a* to be supplied to EL element 12, is not present, and corresponding EL element 12 does not emit light.

In synchronization with the control of EL element 12, a video signal is applied to the Y2 terminal. The ON-state voltage (VGL) is applied to the Y1 terminal, the transistors of test circuit 20 is turned on, and a video signal voltage for a test is applied to source signal line 18.

The video signal voltage for a test is applied for the t2 period or the t1 period in FIG. 10, for example.

Figure 11:
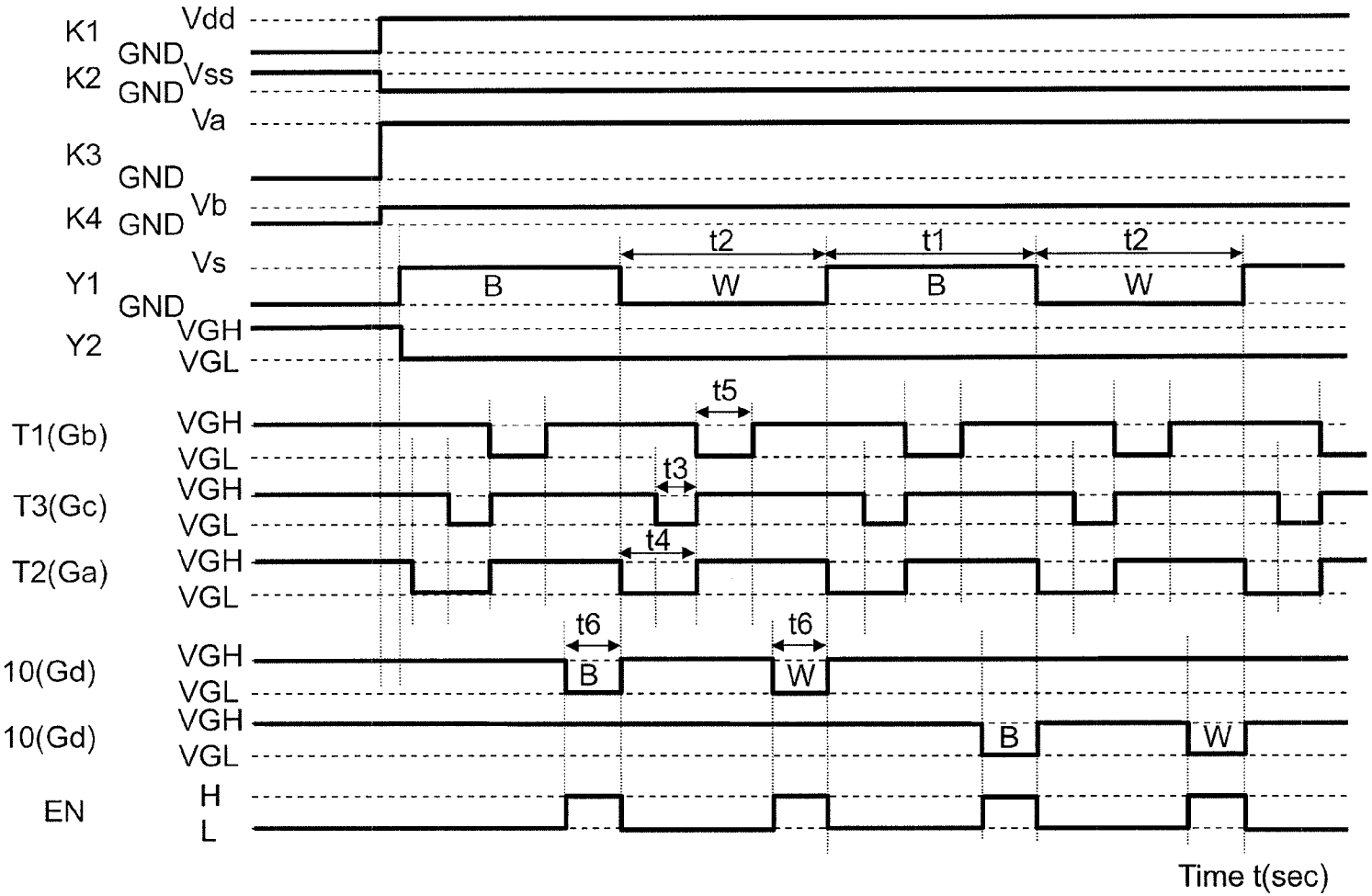
FIG. 11 is a diagram showing another example of the voltage waveform supplied to the main part of FIG. 9.

The voltage waveform shown in FIG. 10 is an example of alternately performing black display and white display of two pixels of an even number and an odd number, or the like. However, a voltage waveform shown in FIG. 11 may be supplied. In an example shown in FIG. 11, one pixel is displayed in black and then displayed in white, and a next pixel is displayed in black and then displayed in white. That is, in two pixels, black display and white display are alternately performed.

Figure 12:
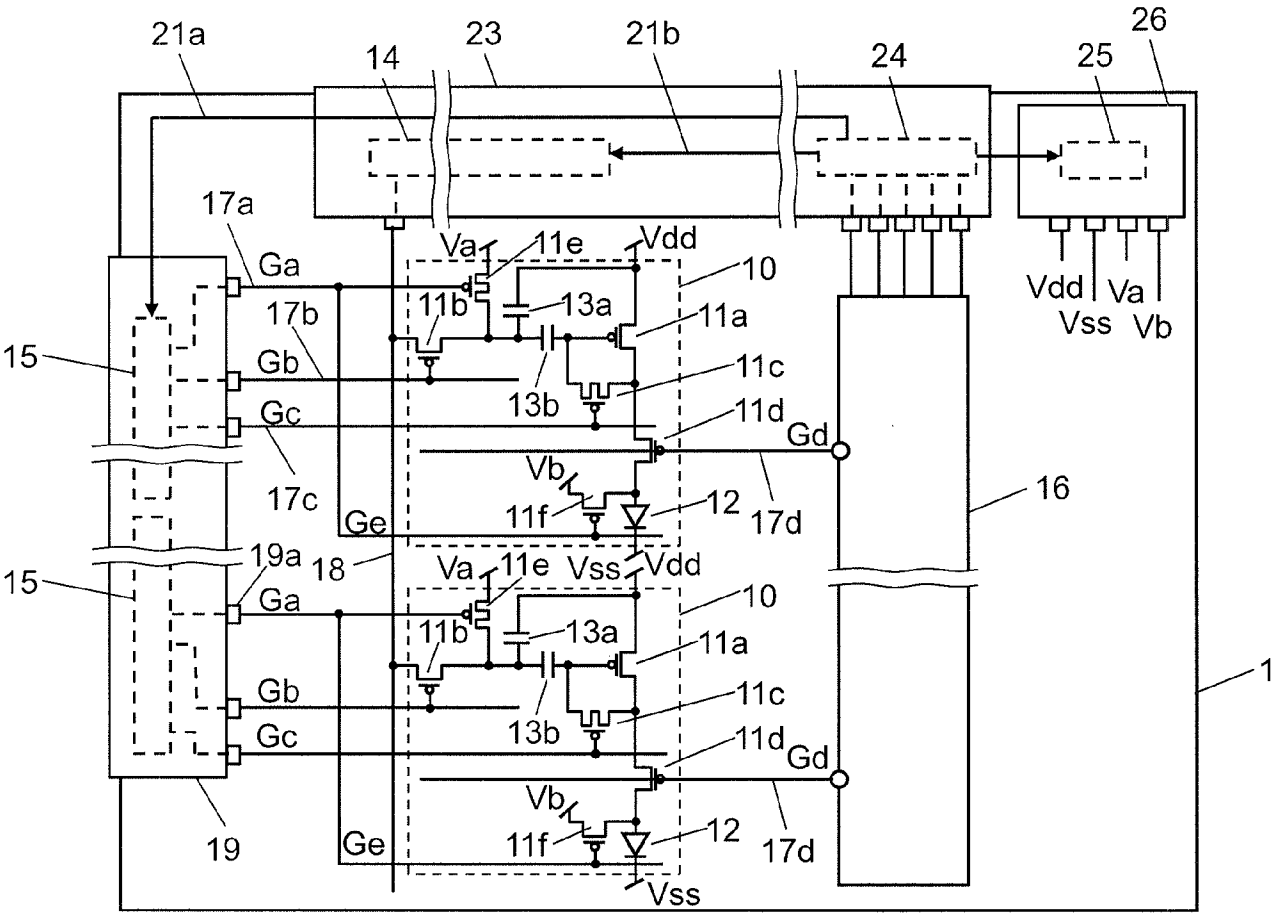
FIG. 12 is a configuration diagram showing the EL display device according to the exemplary embodiment.

FIG. 12 is a configuration diagram showing a whole configuration of the EL display device. FIG. 12 shows a state where the substrate of EL display panel 1 is cut with A-A line and B-B line after inspection is performed as shown in FIG. 9, and thereafter the externally connected driver circuit is mounted.

As shown in FIG. 12, EL display panel 1 includes flexible board (COF) 23 that is mounted with source driver IC 14, and flexible board (COF) 19 that is mounted with gate driver IC 15. Additionally, flexible board (COF) 23 that is mounted with source driver IC 14 is also mounted with IC 24 for control, and is connected to gate driver circuit 16 so as to supply a timing signal for controlling operation. That is, source driver IC 14 supplies a timing signal synchronized with a video signal to IC 24 for control, and IC 24 for control shifts a level of a voltage of the timing signal, thereby controlling gate driver circuit 16. Reference numeral 25 denotes an IC for current control, and is mounted with flexible board (COF) 26.

As described above, the present disclosure relates to an EL display device including: EL display panel 1 that has a display area provided with a plurality of pixels 10 arranged in a matrix, each of pixels 10 having EL element 12; source driver IC 14 that serves as a source driver circuit which supplies a video signal through source signal line 18 connected to each pixel 10; and a gate driver circuit that supplies a selection voltage or a non-selection voltage through gate signal line 17 that is connected to each pixel 10. Each pixel 10 has: driving transistor 11*a* that supplies a current to EL element 12; first switching transistor 11*d* that is connected to driving transistor 11*a* and controls the current supplied to EL element 12; and second switching transistors 11*b*, 11*c* and 11*e* that are connected to source signal line 18 and supply video signals to pixel 10. The gate driver circuit includes: gate driver circuit 16 that serves as a first gate driver circuit which is formed and disposed along with pixels 10 on EL display panel 1; and gate driver IC 15 that serves as a second gate driver circuit which is externally connected to gate signal lines 17*a*, 17*b* and 17*c* of EL display panel 1. Gate driver circuit 16 is connected to a gate terminal of first switching transistor 11*d* of each pixel 10 via gate signal line 17*d*, and gate driver IC 15 is connected to gate terminals of second switching transistors 11*b*, 11*c* and 11*e* of each pixel 10 via gate signal lines 17*a*, 17*b* and 17*c*.

With such a configuration, first switching transistors 11*d* having small loads are driven with gate driver circuit 16 that is incorporated in EL display panel 1, and second switching transistors 11*b*, 11*c* and 11*e* having large loads are driven with the gate driver circuit IC that is externally connected to EL display panel 1. It is possible to implement optimum on/off control of each of a plurality of the transistors that configures each pixel 10, and to implement an EL display device that has allows simple inspection with a simple configuration. Additionally, at the time of panel inspection, incorporated gate driver circuit 16 is operated, and a probe is simply brought into press contact with only a terminal that needs inspection, so that the panel can be inspected. Consequently, it is possible to perform rapid inspection.

The EL display device can be utilized as a display of a video camera, a digital camera, a goggle type display, a navigation system, a car audio, an audio component, a computer, a game machine, a personal digital assistant (a mobile computer, a mobile phone, a handheld game console, an electronic book, or the like), picture reproducer including a recording medium, or the like.

INDUSTRIAL APPLICABILITY

As described above, the present invention is useful for implementation of a high reliable EL display device.

REFERENCE MARKS IN THE DRAWINGS

1 EL display panel
10 pixel
11, 11*a*, 11*b*, 11*c*, 11*d*, 11*e*, 11*f* transistor
12 EL element
13, 13*a*, 13*b*, 13*c*, 13*d*, 13*e* capacitor
14 source driver IC
15 gate driver IC
16 gate driver circuit
17, 17*a*, 17*b*, 17*c*, 17*d*, 17*e* gate signal line
18 source signal line
19 flexible board (COF)
23 flexible board (COF)
26 flexible board (COF)
20 test circuit

The invention claimed is:

1. An electroluminescence (EL) display device, comprising:

a circuit board that includes a plurality of terminals;

an EL display panel that has a display area provided with a plurality of pixels arranged in a matrix, each of the pixels having an EL element;

a source driver circuit that supplies a video signal through a source signal line connected to each of the pixels; and a gate driver circuit that supplies a selection voltage or a non-selection voltage through a gate signal line that is connected to each of the pixels, wherein each of the pixels has: a driving transistor that supplies a current to the EL element; a first switching transistor that is connected to the driving transistor and controls the current supplied to the EL element; and a second switching transistor that is connected to the source signal line and supplies the video signal to each of the pixels, the gate driver circuit includes: a first gate driver circuit that is formed and disposed along with each of the pixels on the EL display panel; and a second gate driver circuit that is mounted on the circuit board and externally connected to the gate signal line of each of the pixels of the EL display panel, the first gate driver circuit is directly connected to a gate terminal of the first switching transistor of each of the pixels via the gate signal line, and the second gate driver circuit is indirectly connected to a gate terminal of the second switching transistor of each of the pixels via the gate signal line, with the plurality of terminals interconnecting the second gate driver circuit and the gate signal line of each of the pixels of the EL display panel.

2. The EL display device according to claim 1, wherein the gate signal line of each of the pixels of the EL display panel has a first end connected to the first gate driver circuit, and a second end connected to one of the plurality of terminals.

3. The EL display device according to claim 1, wherein a test circuit that supplies a test signal through a source signal line connected to each of the pixels is further formed in the EL display panel.

4. The EL display device according to claim 3, wherein the source signal line of the EL display panel has a first end connected to the source driver circuit, and a second end connected to the test circuit.

5. The EL display device according to claim 1, wherein the circuit board is a flexible board, and the first gate driver circuit is incorporated in the EL display panel.

6. The EL display device according to claim 1, wherein the gate signal line of each of the pixels includes a first wire connected to the first gate driver circuit and a second wire connected to one of the plurality of terminals, and a wiring resistance of the first wire is lower than a wiring resistance of the second wire.

7. A production method for an electroluminescence (EL) display device, the EL display device including: a circuit board that includes a plurality of terminals; an EL display panel that has a display area provided with a plurality of pixels arranged in a matrix, each of the pixels having an EL element; a source driver circuit that supplies a video signal through a source signal line connected to each of the pixels; and a gate driver circuit that supplies a selection voltage or a non-selection voltage through a gate signal line that is connected to each of the pixels, each of the pixels having: a driving transistor that supplies a current to the EL element; a first switching transistor that is connected to the driving transistor and controls the current supplied to the EL element; and a second switching transistor that is connected to the source signal line and supplies the video signal to each of the pixel, and the gate driver circuit having: a first gate driver circuit that is formed and disposed along with each of the pixels on the EL display panel; and a second gate driver circuit that is mounted on the circuit board and externally connected to the gate signal line of each of the pixels of the EL display panel, the production method comprising:

directly connecting the first gate driver circuit to a gate terminal of the first switching transistor of each of the pixels via the gate signal line, indirectly connecting the second gate driver circuit to a gate terminal of the second switching transistor of each of the pixels via the gate signal line, with the plurality of terminals interconnecting the second gate driver circuit and the gate signal line of each of the pixels of the EL display panel, forming a test circuit that supplies a test signal to each of the pixels of the EL display panel through the source signal line, performing inspection for supplying the test signal to each of the pixels of the EL display panel, and then separating the test circuit from the EL display panel.

8. The production method for an EL display device according to claim 7 comprising:

connecting the source driver circuit to a first end of the source signal line of the EL display panel, connecting the test circuit to a second end, performing the inspection for supplying the test signal to each of the pixels of the EL display panel, and thereafter separating the test circuit from the EL display panel.

9. The production method for an EL display device according to claim 7, wherein the circuit board is a flexible board, and the first gate driver circuit is incorporated in the EL display panel.

10. The production method for an EL display device according to claim 7, wherein the gate signal line of each of the pixels includes a first wire connected to the first gate driver circuit and a second wire connected to one of the plurality of terminals, and a wiring resistance of the first wire is lower than a wiring resistance of the second wire.

* * * * *